US008389841B1

(12) United States Patent
Stevens

(10) Patent No.: US 8,389,841 B1
(45) Date of Patent: Mar. 5, 2013

(54) ADJUSTABLE RESONATOR STOP AND KEYBOARD PERCUSSION INSTRUMENT INCLUDING SAME

(76) Inventor: Leigh Howard Stevens, Neptune, NJ (US)

( * ) Notice: Subject to any disclaimer, the term of this patent is extended or adjusted under 35 U.S.C. 154(b) by 3 days.

(21) Appl. No.: 13/219,850

(22) Filed: Aug. 29, 2011

(51) Int. Cl.
*G10D 13/08* (2006.01)

(52) U.S. Cl. ..... 84/410

(58) Field of Classification Search ..... 84/410
See application file for complete search history.

(56) References Cited

U.S. PATENT DOCUMENTS 1,127,320 A * 2/1915 Tiffner ..... 181/160
1,173,507 A * 2/1916 Haskell ..... 84/170
1,293,722 A * 2/1919 Deagan ..... 84/410
1,293,723 A * 2/1919 Deagan ..... 84/410
1,369,268 A * 2/1921 Deagan ..... 84/410
3,443,469 A * 5/1969 Hiraoka ..... 84/410
4,570,525 A * 2/1986 Suzuki ..... 84/410
4,941,386 A * 7/1990 Stevens ..... 84/410
5,189,236 A * 2/1993 Stevens ..... 84/410
7,361,822 B1 * 4/2008 Hsieh ..... 84/410
7,642,437 B2 * 1/2010 Terada ..... 84/179
7,709,715 B2 * 5/2010 Stevens et al. ..... 84/402
7,804,014 B2 * 9/2010 Terada ..... 84/410

* cited by examiner

*Primary Examiner* — David Warren
*Assistant Examiner* — Robert W Horn
(74) *Attorney, Agent, or Firm* — Grossman Tucker Perreault & Pfleger, PLLC

(57) ABSTRACT

An adjustable resonator stop may be used in resonators of keyboard percussion instruments. The adjustable resonator stop includes a resonator engaging body having a cavity, a resonator end member being configured to be disposed within the cavity of the resonator engaging body, and a tightening member coupled to at least a portion of the resonator end member. The tightening member is configured to move the resonator end member from a disengaged position, wherein the resonator stop may be freely adjusted within a resonator, to an engaged position, wherein the resonator stop may be securely coupled to an interior surface of the resonator. The adjustable resonator stop may provide the same or better performance characteristics as a permanently installed metal stop including a smooth, metallic, bi-polar vibrating surface with exposure to air on either side, while also providing quick adjustability at little or no cost when compared to other adjustable stops in the industry.

20 Claims, 9 Drawing Sheets

ADJUSTABLE RESONATOR STOP AND KEYBOARD PERCUSSION INSTRUMENT INCLUDING SAME

FIELD

The present disclosure relates generally to keyboard percussion instruments, and, more particularly, to an adjustable stop for a resonator associated with a tone bar of a keyboard percussion instrument.

BACKGROUND

Keyboard percussion instruments, such as vibraphones and marimbas, are musical instruments that have tone bars and are played upon by musicians with mallets. Keyboard percussion instruments of the type played on by hand-held mallets fall into two distinct categories: non-resonator instruments such as the glockenspiel (orchestra bells) and chimes (tubular bells); and resonated instruments such as the marimba, xylophone and vibraphone ("vibes").

Resonated instruments such as the vibraphone have resonating air chambers, e.g. resonators, acoustically coupled with associated vibrating tone bars located above. The resonators of keyboard percussion instruments serve to amplify the sound of the tone bar resting above. In order to achieve the optimal relationship between each tone bar and resonator, it is desirable to have the resonator respond sympathetically, or be tuned to, a certain pitch with respect to its associated tone bar. When a resonator is tuned very closely to the pitch of its associated tone bar, the resulting tone when the bar is struck is loud, but relatively short in duration. With a slight amount of de-tuning of the resonator, the resulting tone is not so loud, but persists longer. The degree of de-tuning and whether the de-tuning is above or below the pitch of the tone bar has a significant effect on the quality of the resultant tone. Different musical selections call for different tonal responses. Therefore, it is desirable for the performing artist to be able to select or adjust the response of his instrument to achieve the tonal response for the musical selection to be performed.

Keyboard percussion instruments can be particularly cumbersome in terms of tuning and tone quality. These types of instruments may go out of tune in a variety of environmental conditions. In warm temperature and high humidity, for example, the tone bars may go flat and the resonators may go sharp. In cool and dry weather, the opposite condition may result. These varying conditions have an adverse effect, not only on the pitch of the instrument, but also on the tone quality. Due to the fact that these types of instruments rely on sympathetic resonance of the resonator tube to the tone bar, unmusical results may occur if the two vibrating systems are not in tune.

Despite these problems with varying environmental conditions as well as tuning, keyboard percussion instruments are usually sold with non-movable force-fit metal stops in the resonator tubes. A forced-fit, domed metal stop produces a strong, long-ringing (lossless), brightly toned, reflective surface. The resonator, usually made from aluminum or brass tubing, has no air leakage or energy losses because the metal plug is forced into the tube (e.g., with a hydraulic press), producing a perfect air seal around the circumference between the outer diameter surface of the stop and the inner wall of the resonator tube.

Many instruments of this type are supplied with one end of the resonator tube (the end furthest from the tone bar), permanently sealed at a distance that produces a resonant frequency equal to the associated tone bar above. When the resonator is associated with a tone bar tuned to, for example, A=440, the manufacturer sets the stop in the tube to produce a resonant frequency as close to A=440 as possible. Positioning the stop slightly sharp or flat to A=440 produces different results, such as altered ring times, volume and timbre. These permanent stops are prepositioned at the factory to resonate the above-suspended bar at a particular temperature and humidity level.

The position of these plugs is determined not only by the temperature and weather conditions at the point of manufacture but also by the taste of the designer and accidents and/or inconsistencies of manufacturing. When the instrument is played in an environment that exactly duplicates that for which it was tuned (e.g., about 50% humidity and 72° F.), these resonators should perform well. A reduction of the ambient air temperature by as little as 4° F., however, substantially reduces the volume potential of the instrument while increasing the apparent ring-time of the bar, adversely influencing the tone character of the combined bar/resonator system. Conversely, an increase of 4° F. in the ambient temperature reduces the apparent ring-time of the bar/resonator system to a level that even a lay person can hear easily.

Until recently, musicians have generally had to endure these shortcomings in performance. Even if the musician could take along all the wood-working or metal-working equipment to tune the tone bars at the performance site, this would not be a viable method to compensate for transitory weather conditions because tuning the tone bar requires removing material from the bar. After a few tunings by removing material, permanent loss of mass begins to be audible as loss of tone quality. Thus, a better way to bring these two sympathetically-vibrating systems into musical resonance is to change the effective length of the resonator tube.

Several movable/tunable stop systems have been introduced. Although some of them offer tuning and volume advantages over the permanently installed metal stops used by the vast majority of manufacturers, each has one or more significant drawbacks. For instance, some versions of movable stops merely squeeze a flexible rubber membrane between two rigid plastic disks or plates. While this system is functional and produces an air-tight seal, it does not produce good musical or ergonomic results. One drawback with this type of stop is that it is very slow to tighten and/or loosen the clamping device sufficiently to allow movement. Additionally, the assembly can easily camber out of 90-degrees square to the inside wall of the tube as it is being loosened or adjusted. It can also be incorrectly tightened in an out-of-square, cambered position. Any of the out of square cambered conditions produces unacceptable "out of focus" timbre and false harmonics. Also, the system is never completely rigid after tightening the two plates together, because the rubber membrane sealing against the inside diameter of the tube is by soft and flexible. Lastly, a significant cross-section of the soft, flexible material is exposed to the vibrating air column in the resonator.

Other versions of movable/tunable stop systems use an O-ring around a disk. While this system is functional and produces an air-tight seal, it does not produce good musical or ergonomic results. When the stop is moved against the friction of the O-ring, the O-ring alternately drags and then rolls, so that only certain positions of the stop can be selected. Additionally, the cleanliness or "focus" of the pitch and harmonicity of the overtones are degraded by the pitch conflict produced by the space between the flat top plate and the actual seal, which is a bit further from the open end of the tube. Other hybrid designs, such as squeezing the O-ring between two disks or plates also share many of these same shortcomings.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION

The present disclosure is generally directed to an adjustable resonator stop configured for use with resonators of keyboard percussion instruments. The adjustable resonator stop may include a resonator engaging body defining a cavity, a resonator end member disposed within the cavity of the resonator engaging body, and a tightening member coupled to at least a portion of the resonator end member. The tightening member moves the resonator end member from a disengaged position, wherein the resonator stop may be freely adjusted within a resonator, to an engaged position, wherein the resonator stop is securely engaged with an interior surface of the resonator. An adjustable resonator stop consistent with the present disclosure may be configured to provide the same or better performance characteristics as a permanently installed metal stop including a smooth, metallic, bi-polar vibrating surface with exposure to air on either side, while also providing quick adjustability at little or no cost when compared to other adjustable stops.

The embodiments disclosed herein may be used in conjunction with resonators for a variety of different keyboard percussion instruments. As used herein, "keyboard percussion instrument" refers to an instrument including resonators acoustically coupled to associated tone bars. The tone bars, which may be made of wood, metal, steel, fiberglass or other acceptable materials, are struck with mallets to produce musical tones. Non-limiting examples of keyboard percussion instruments include marimbas, vibraphones, and xylophones.

Figure 1:
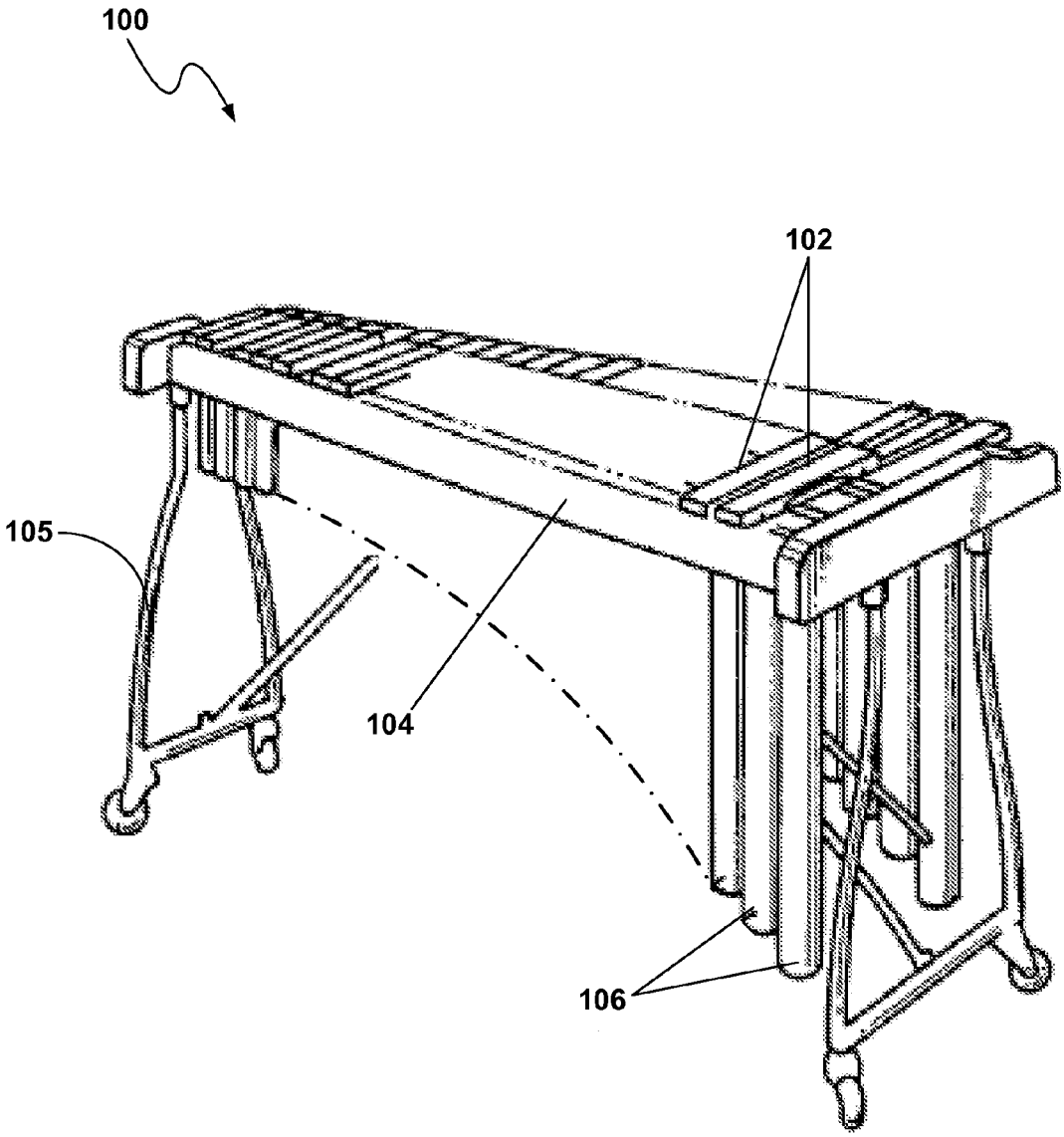
FIG. 1 is a perspective view of an exemplary keyboard percussion instrument.

Referring to FIG. 1, the keyboard percussion instrument 100 may include a graduated series of keys known as tone bars 102 arranged on support rails 104 such that the tone bars 102 are allowed to ring freely when struck by a mallet (not shown). The tone bars 102 and support rails 104 may form a tone bar rail assembly (sometimes referred to as the "harp"). The keyboard percussion instrument 100 may further include a frame 105 that supports the tone bar rail assembly. The keyboard percussion instrument 100 may also include resonators 106 of different lengths mounted below the tone bars 102 and associated with each resonator 106. Each of the resonators 106 may be configured to provide an air column approximately resonant to the pitch of an associated tone bar 102. Embodiments of the adjustable resonator stop consistent with the present disclosure are configured to be used with such resonators 106.

Figure 2:
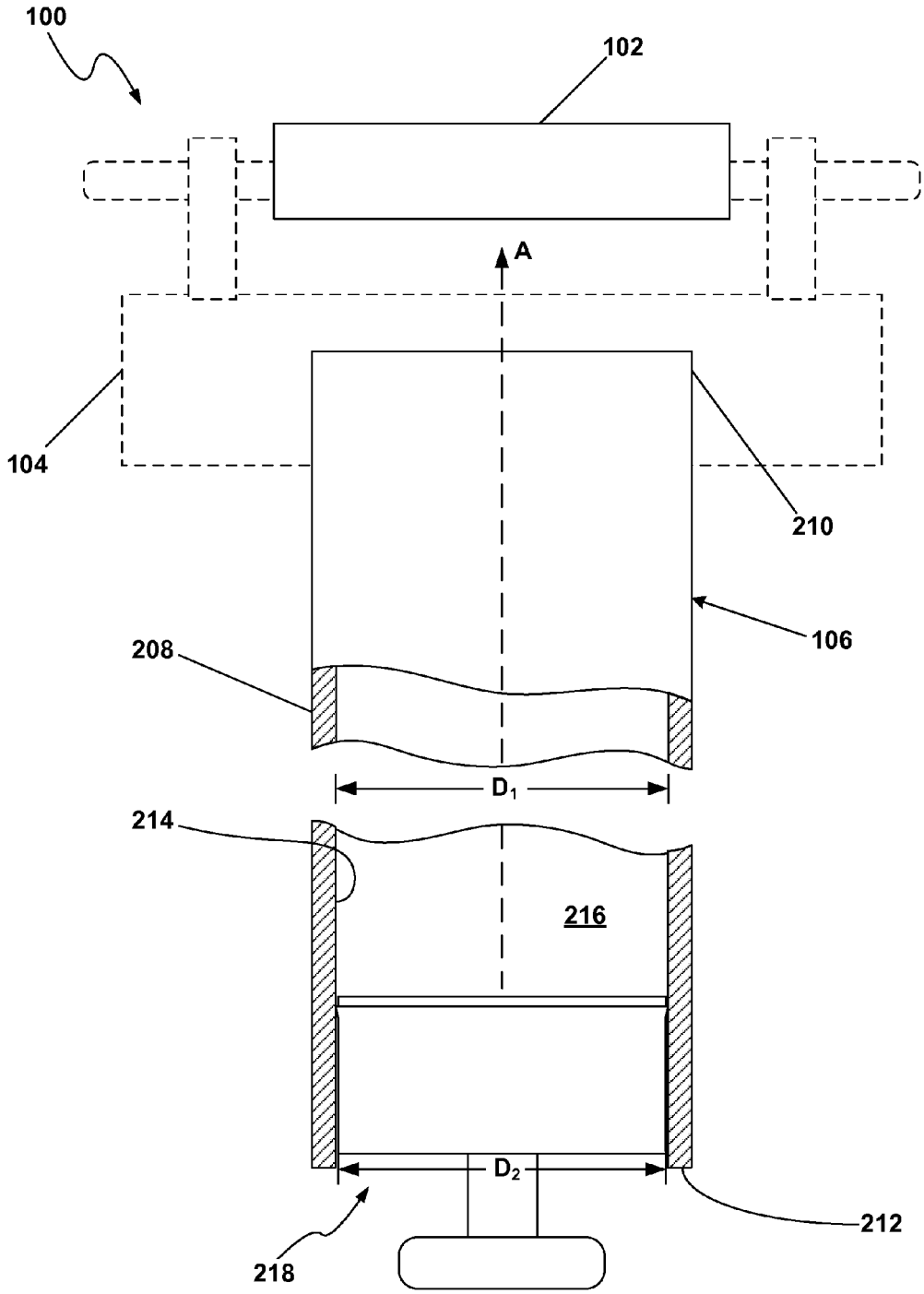
FIG. 2 is a side view, partly in section, of a resonator of the keyboard percussion instrument of FIG. 1 with an adjustable resonator stop inside the resonator.

As shown in greater detail in FIG. 2, an exemplary resonator 106 consistent with the keyboard percussion instrument 100 may include a hollow, substantially tubular cross-section. For purposes of discussion, the keyboard percussion instrument includes round tubular resonators; however, an adjustable resonator stop consistent with the present disclosure may be configured for use with resonators having varying shapes and/or dimensions. The resonator 106 may include a hollow body 208 having an open proximal end 210 and an open distal end 212, wherein the proximal end 210 may be positioned directly below an associated tone bar 102. The hollow body 208 may further include an interior surface 214 extending the length of the hollow body 208 and defining an inner diameter $D_1$ and an interior volume 216. The interior volume 216 may include a vibrating air column when an associated tone bar 102 is struck. A longitudinal axis A of the resonator 106 runs from the distal end 212 to the proximal end 210. For purposes of discussion, the longitudinal axis A of the resonator 106 lies along a vertical plane.

In the illustrated embodiment, an adjustable resonator stop 218 may be shaped and/or sized to fit within the hollow body 208 of the resonator 106 proximate the distal end 212 of the resonator 106. In particular, at least a portion of the adjustable resonator stop 218 may define an outer diameter $D_2$ that is less than the inner diameter $D_1$ defined by the interior surface 214 of the resonator 106. The adjustable resonator stop 218 may be moved within the interior volume 216 defined by the resonator 106 and fixed at different locations to define vibrating air columns of different lengths.

Figure 3:
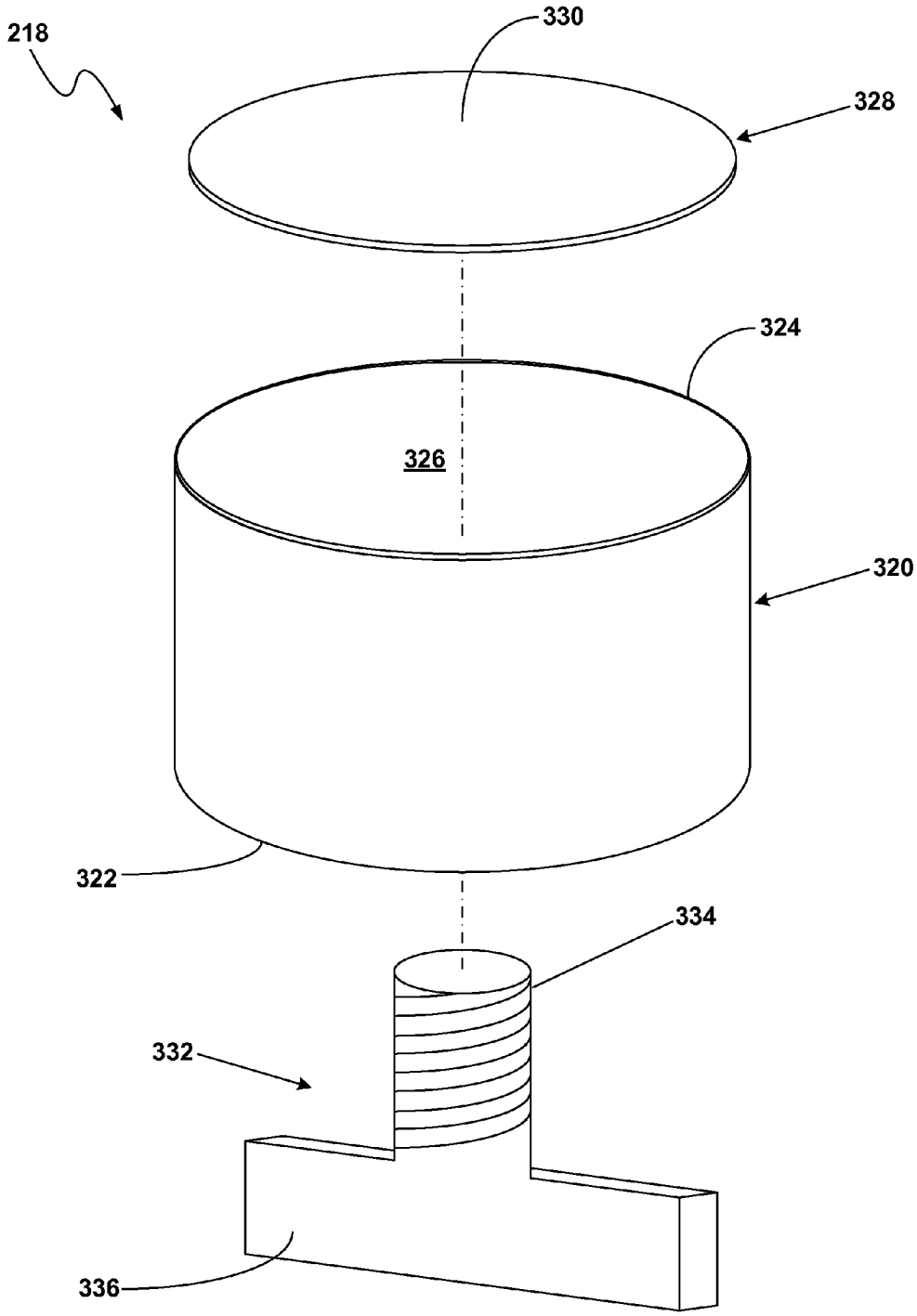
FIG. 3 is an exploded perspective view of the adjustable resonator stop of FIG. 2.

As shown in greater detail in FIG. 3, the adjustable resonator stop 218 may include a resonator engaging body 320 configured to be disposed within the resonator 106 of the keyboard percussion instrument 100. The resonator engaging body 320 may include a first end 322 and an open second end 324 and also includes a cavity 326 defined therein. The adjustable resonator stop 218 also includes a resonator end member 328 shaped and/or sized to be disposed within the cavity 326 of the resonator engaging body 320. The resonator end member 328 may include a top surface 330 exposed to the interior volume 216 of the resonator 106 when adjustable resonator stop 218 is assembled and disposed within the resonator 106, thereby forming a closed end of a vibrating air column. The top surface 330 may be configured to vibrate and/or reflect high frequency sound efficiently back up the resonator 106 when exposed to the air column in the internal volume 216. As shown, the resonator end member 328 is disk-shaped and the top surface 330 is substantially planar (i.e., lying along a horizontal plane substantially perpendicular to axis A). In other embodiments, the resonator end member 328 and/or the top surface 330 may have other shapes and/or dimensions including, but not limited to, arcuate, domed, and the like.

The adjustable resonator stop 218 may further include a tightening member 332 configured to be coupled to at least a portion of the resonator end member 328 and to move the resonator end member 328 relative to the resonator engaging body 320 from a disengaged position to an engaged position. In the disengaged position, the resonator end member 328 is disengaged from the resonator engaging body 320 allowing the resonator engaging body 320 to move freely within a resonator 106. In the engaged position, the resonator end member 328 engages the resonator engaging body 320 causing the resonator engaging body 320 to engage the resonator 106 at a fixed location. As shown, the tightening member 332 includes a first end 334 configured to be coupled to at least a portion of the resonator end member 328 and a second end 336 for providing a user with leverage for adjusting the resonator end member 328 from the disengaged position to the engaged position.

Figure 4:
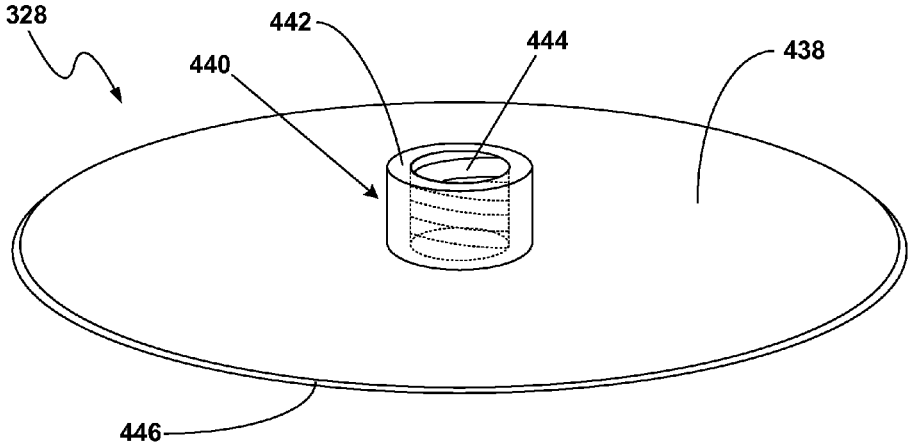
FIG. 4 is a perspective view of the resonator end member of the adjustable resonator stop of FIG. 2.

As shown in further detail in FIG. 4, the resonator end member 328 may include a bottom surface 438 configured to vibrate in response to an associated tone bar 102 being struck. The bottom surface 438 may include an attachment member 440 configured to be coupled to at least the first end 334 of the tightening member 332. In the illustrated embodiment, the attachment member 440 includes a blind hole 442 with an internally threaded bore 444. The bore 444 may be shaped and/or sized for receiving at least a portion of the first end 334 of the tightening member 332. As shown in FIG. 3, for example, the first end 334 of the tightening member 332 may define a threaded surface configured to engage the corresponding threaded bore 444 of the blind hole 442 and secure the resonator end member 328 to the tightening member 332.

The attachment member 440 may be formed as one piece with the resonator end member 328, for example, by turning a single bar stock of material (e.g., aluminum). In other embodiments, the attachment member 440 may be formed as a separate piece (e.g., a threaded female stud) that is attached to the surface 438 of the resonator end member 328, for example, with adhesive if aluminum is used or by spot welding if stainless steel is used. Although the attachment member 440 is shown as a threaded female stud, the attachment member 440 may be a male threaded stud and the tightening member 332 may be a standard wing nut.

As understood by one skilled in the art, the first end 334 of the tightening member 332 may be coupled to at least the bottom surface 438 of the resonator end member 328 by other means. Other mechanisms may also be used to move the resonator end member 328 into engagement with the resonator engaging body 320. For example, a tightening member may include a biasing member coupled to an attachment member defined on the bottom surface of the resonator end member, wherein the biasing member may translate from a disengaged position, wherein the resonator end member is disengaged from the resonator engaging body, to an engaged position, wherein the biasing member pulls the resonator end member into the resonator engaging body.

As shown, the resonator end member 328 may define a peripheral edge 446 shaped and/or sized to fit within the cavity 326 of the resonator engaging body 320 and to engage a portion of the open second end 324 of the resonator engaging body 320. The resonator end member 328 may include a durable and substantially rigid material capable of vibrating and/or reflecting high frequency sound. The material may include a metal such as, but not limited to, brass, aluminum, and/or combinations thereof.

Figure 5:
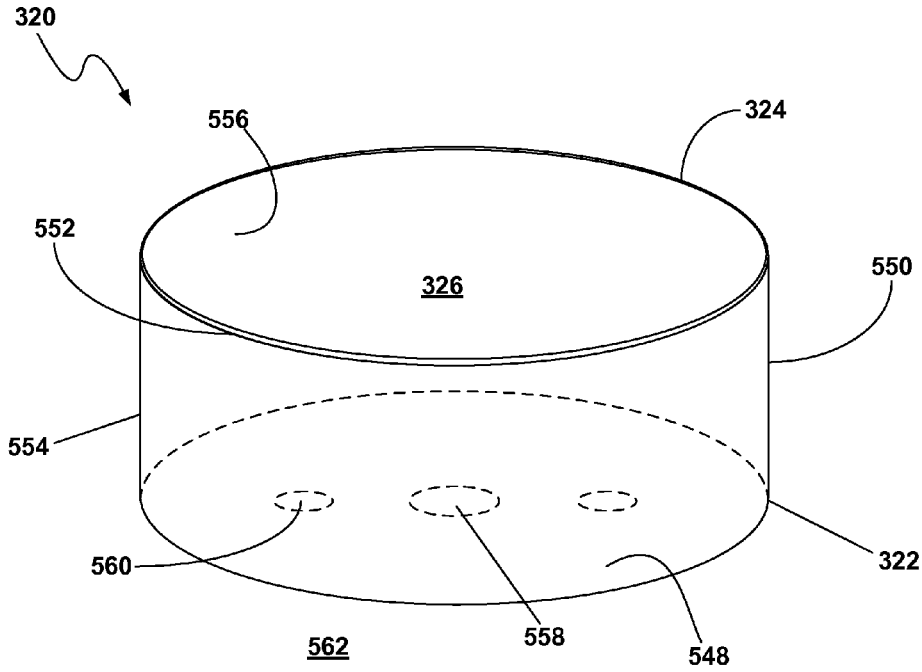
FIG. 5 is a perspective view of the resonator engaging body of the adjustable resonator stop of FIG. 2.

As shown in greater detail in FIG. 5, the resonator engaging body 320 may include an end wall 548 defined at the proximal end 322 and a continuous side wall 550 extending substantially longitudinally along axis A from a periphery of the end wall 548. The side wall 550 may terminate at a radially expandable lip 552 defined on a periphery of the second end 324 of the resonator engaging body 320. The side wall 550 may define an exterior surface 554 configured to form a slip fit with an interior dimension of the resonator 106, e.g. the interior surface 214 of the resonator 106 (see FIG. 2). Additionally, the side wall 550 may define an interior surface 556 defining the cavity 326 within the resonator engaging body 320.

As shown, the end wall 548 may include an aperture 558 shaped and/or sized to receive at least a portion of the first end 334 of the tightening member 332 and to allow at least a portion of the first end 334 to be disposed within the cavity 326 and be coupled to a portion of the resonator end member 328. As shown, the end wall 548 may further include at least one venting aperture 560 for venting air through the resonator engaging body 320 to the resonator end member 328. Although the end wall 548 defines two venting apertures 560 in the illustrated embodiment, the end wall 548 may define more or fewer venting apertures having a variety of dimensions and/or configurations, as well as placement on the end wall.

When the adjustable resonator stop 218 is assembled and the resonator end member 328 is in the engaged position, the venting aperture(s) 560 may be configured to effectively vent the cavity 326 and at least the bottom surface 438 of the resonator end member 340 to any surrounding air 562 located outside of the resonator engaging body 320 and/or resonator 106. The venting aperture(s) thus 560 allows bi-polar vibration of the resonator end member 328, wherein both the top surface 330 and/or bottom surface 438 of the resonator end member 328 may vibrate more freely when exposed to a vibrating air column when a tone bar 102 is struck. In other words, the bottom surface 438 of the resonator end member 328 may be exposed to air so that any vibration of the resonator end member 328 has the advantage of a bi-polar contribution to the surrounding air. The resonator end member 328 may be configured to act as a type of "drum head" in that the resultant sound is different than a solid plastic or metal stop. Similar to the venting of a snare drum or tom-tom, the resonator end member 328 may vibrate more freely because the bottom surface 438 of the resonator end member 328 encounters less back-pressure created in the cavity 326 of the resonator engaging body 320 due to the venting aperture(s) 560.

In other embodiments, the end wall 548 may be solid, except for aperture 558, and such that the top surface 330 of the resonator end member 328 is configured to vibrate into the interior volume 216 of the resonator 106 and/or into the cavity 326 of the resonator engaging body 320. The bottom surface 438 in these embodiments, however, may encounter back pressure within the cavity 326.

The resonator engaging body 320 may include a resilient and durable material capable of elastic expansion, particularly at the radially expandable lip 552, when a force is applied thereto and capable of elastic recovery when the force is removed therefrom. The material may include, but is not limited to, either natural or synthetic materials such as polymers and/or co-polymers. Examples may include polyurethane, latex, natural rubber, nylon (polyamides), polyester, polyethylene, polypropylene, PVC, fluoroplastics, block copolymers, polyethers and composites thereof. In one embodiment, the resonator engaging body 320 may include a low-density polyethylene (LDPE) material.

Figure 6:
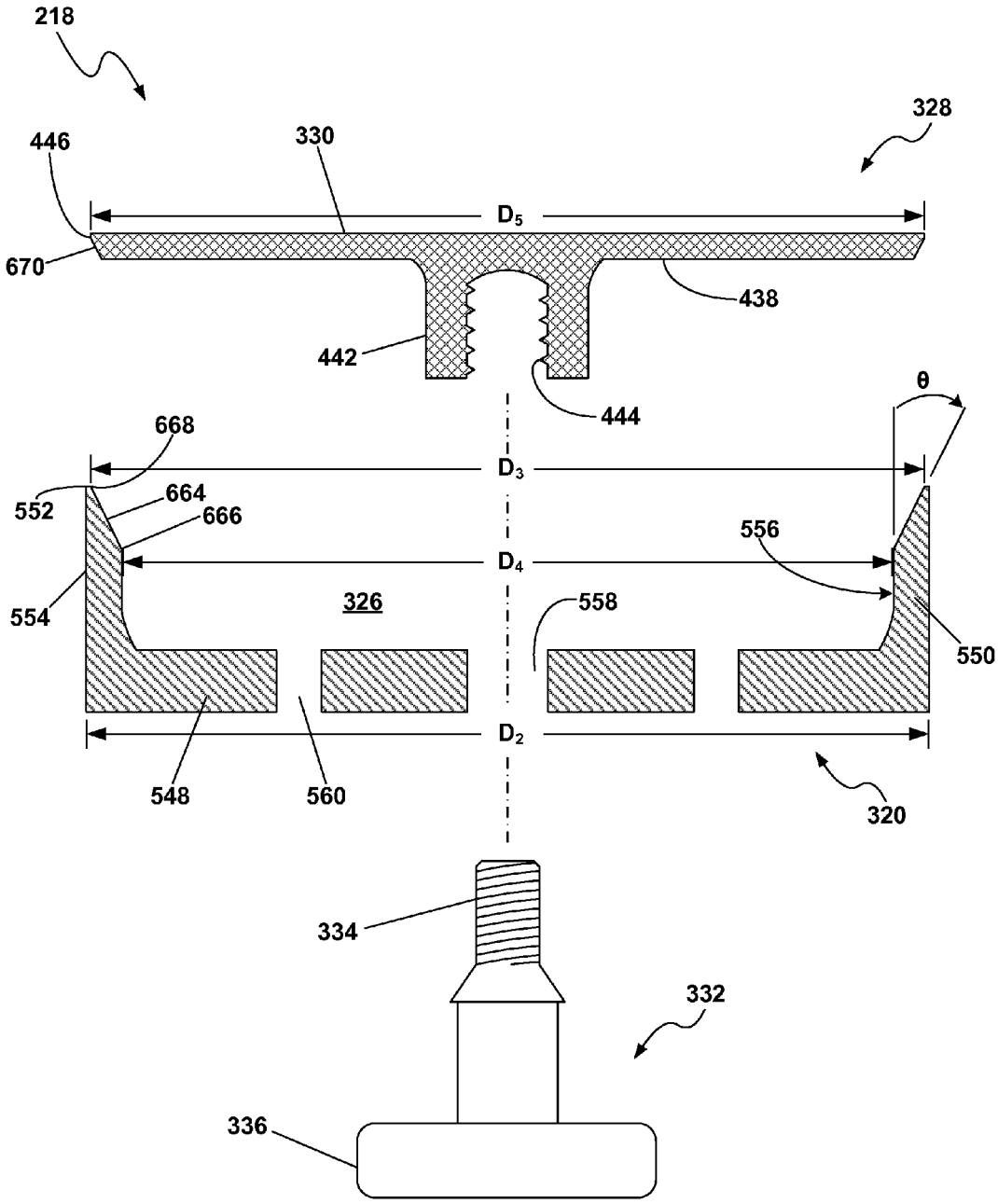
FIG. 6 is an exploded sectional view of the adjustable resonator stop of FIG. 2.

FIG. 6 shows the cross-sectional shape and dimensions of the adjustable resonator stop 218 in further detail. In particular, the resonator engaging body 320 has an outer diameter $D_2$ measured at the exterior surface 554 of the side wall 550, which is dimensioned to provide a mechanical slip fit inside the resonator 106. The outer diameter $D_2$ is less than the inner diameter $D_1$ defined by the interior surface 214 of the resonator 106, and may be about 0.1% to 5.0% less than the inner diameter $D_1$ when the resonator end member 328 is in the disengaged position (e.g., no force is applied to the lip 552 and/or interior surface 556 of the side wall 550 by the resonator end member 328).

In the illustrated embodiment, the interior surface 556 of the side wall 550 may include an angularly disposed interior tapered surface 664 gradually tapering from a first interior portion 666 to a second interior portion 668 terminating at the lip 552 of the side wall 550. The resonator engaging body 320 may include a first interior diameter $D_3$ measured at the second interior portion 668 and a second interior diameter $D_4$ measured at the first interior portion 666. Additionally, the interior tapered surface 664 of the side wall 550 may be oriented at an angle θ of less than 90 degrees relative to the interior surface 556 at the second interior diameter $D_4$.

As shown, at least a portion of the resonator end member 328 is shaped and/or sized to fit within at least a portion of the resonator engaging body 320. In particular, the resonator end member 328 has an outer diameter $D_5$ measured at the peripheral edge 446 of the resonator end member 328, which is less than the first interior diameter $D_3$ of the resonator engaging body 320. As shown, the resonator end member 328 includes an angularly disposed tapered surface 670 extending along a periphery of the resonator end member 328. The tapered surface 670 gradually tapers in width from at least the peripheral edge 446 to the bottom surface 438 of the resonator end member 328. The tapered surface 670 may be shaped and/or sized to form a complementary engagement with at least the interior tapered surface 664 of the side wall 550 of the resonator engaging body 320 when the resonator end member 328 moves from the disengaged position to the engaged position. As shown, for example, the tapered surface 670 of the resonator end member 328 may correspond to the tapered surface 664 on the side wall 550.

In other embodiments, the peripheral edge 446 of the resonator end member 328 may include other dimensions and/or configurations, e.g. a rounded surface or any shape capable of engaging the interior tapered surface 664 of the side wall 550 of the resonator engaging body 320.

Figure 7A:
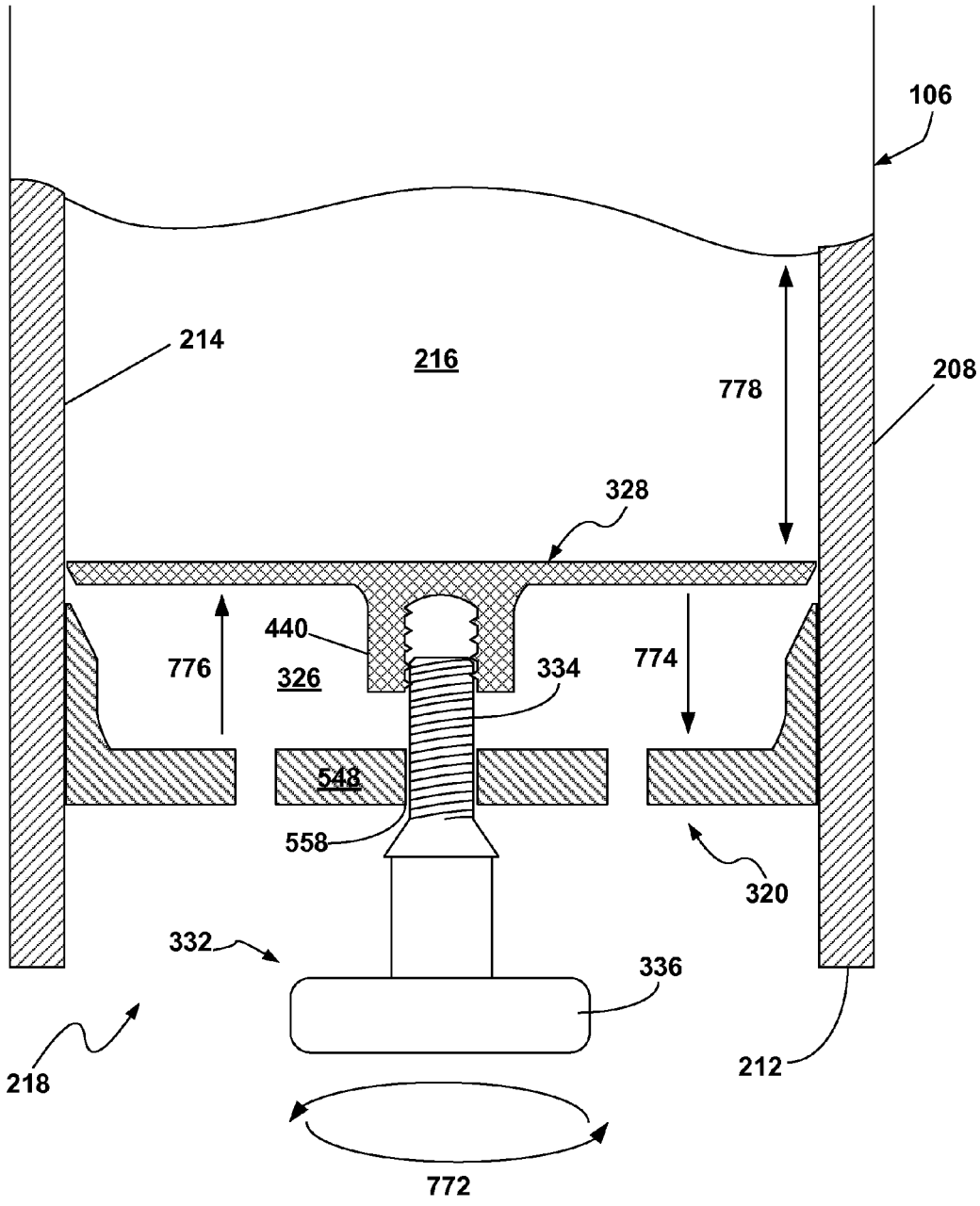
FIG. 7A is a side, partially-sectional view of the adjustable resonator stop of FIG. 2 in a disengaged position within a resonator.
Figure 7B:
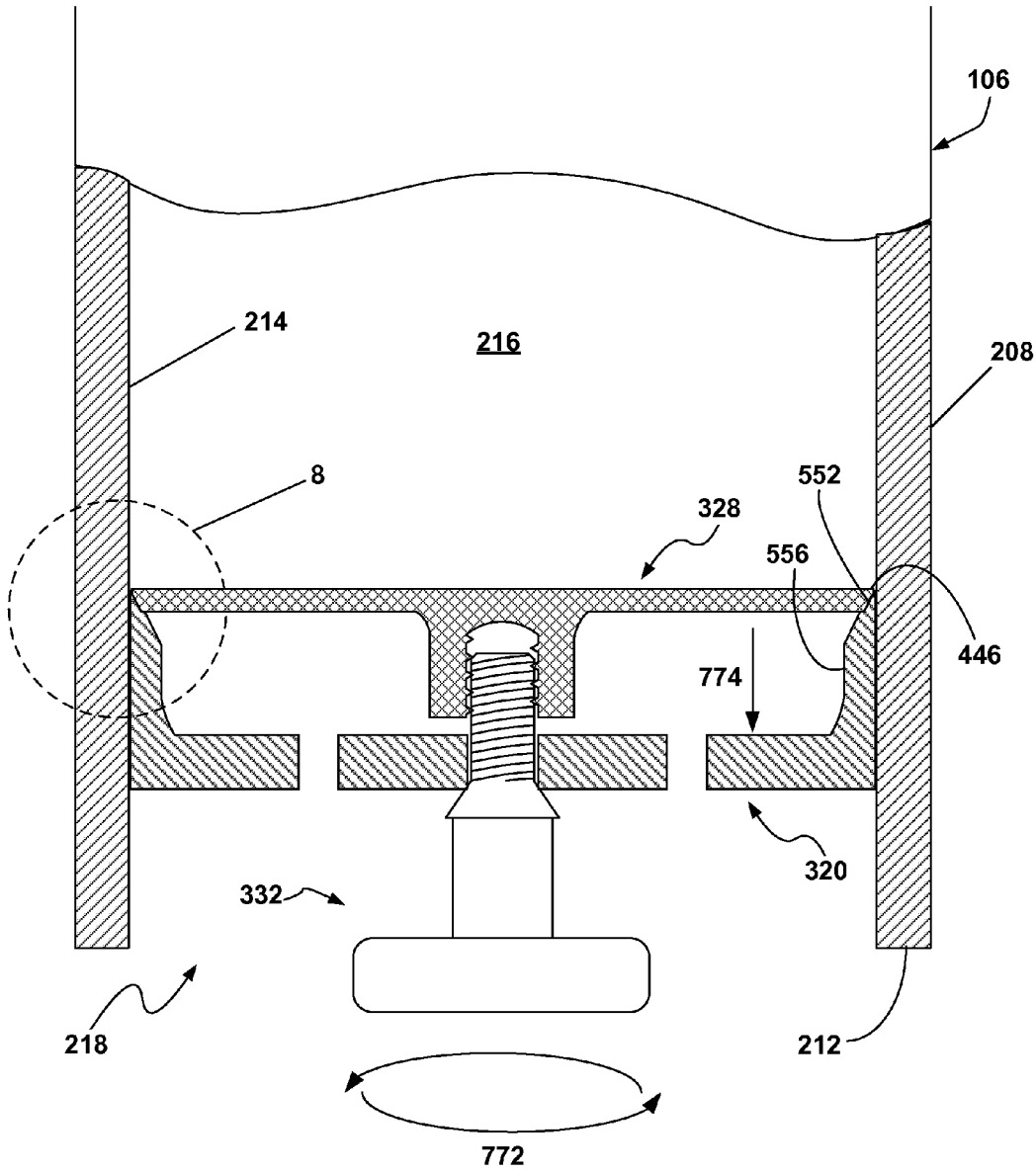
FIG. 7B is a side, partially-sectional view of the adjustable resonator stop of FIG. 2 in an engaged position within a resonator.

FIGS. 7A and 7B illustrate the disengaged and engaged positions, respectively, of the example embodiment of the adjustable resonator stop 218 within a resonator 106. As used herein, the term "disengaged position" refers to a position in which the resonator end member 328 is disengaged from the resonator engaging member 320 and the adjustable resonator stop 218 is freely moveable within an interior dimension of the resonator 106. The term "engaged position" refers to a position in which the resonator end member 328 is engaged with the resonator engaging member 320 and the adjustable resonator stop 218 is fixed within an interior dimension of the resonator 106.

As shown, the first end 334 of the tightening member 332 passes through the aperture 558 of the resonator engaging body 320 and is threadably coupled to the attachment member 440 of the resonator end member 328. In the illustrated embodiment, turning or rotating the tightening member 332 in a direction as indicated by arrows 772 causes the resonator end member 328 to be moved in a direction towards the resonator engaging body 320 as indicated by arrow 774. Turning or rotating the tightening member 332 in a direction opposite the direction indicated by arrows 772 causes the resonator end member 328 to be moved in a direction away from the resonator engaging body 320 as indicated by arrow 776.

When in the disengaged position, as shown in FIG. 7A, the resonator end member 328 is coupled to the tightening member 332 but the resonator engaging body 320 does not engage the resonator 106 and the adjustable resonator stop 218 is able to freely traverse within the interior dimension of the resonator 106, as indicated by the double arrow 778. When the resonator end member 328 is in the disengaged position, therefore, the adjustable resonator stop 218 may be adjusted or moved to a desired position within the resonator 106.

When in the engaged position, as shown in FIG. 7B, the resonator end member 328 engages the resonator engaging body 320 and causes the resonator engaging body 320 to engage the resonator 106 to securely fix the adjustable resonator stop 218. In particular, the tightening member 332 draws the resonator end member 328 in a direction towards to the resonator engaging body 320, as indicated by arrow 774, such that the peripheral edge 446 of the resonator end member 328 engages the interior surface 556 of the resonator engaging body 320. As the resonator end member 328 is drawn into the resonator engaging body 320, the peripheral edge 446 applies a force against the radially expandable lip 552 of the resonator engaging body 320, such that at least a portion of the lip 552 is elastically expanded radially to conform sealably to an interior dimension of the resonator 106, thereby frictionally engaging and fixing the resonator engaging body 320 to the interior dimension of the resonator 106.

Figure 8:
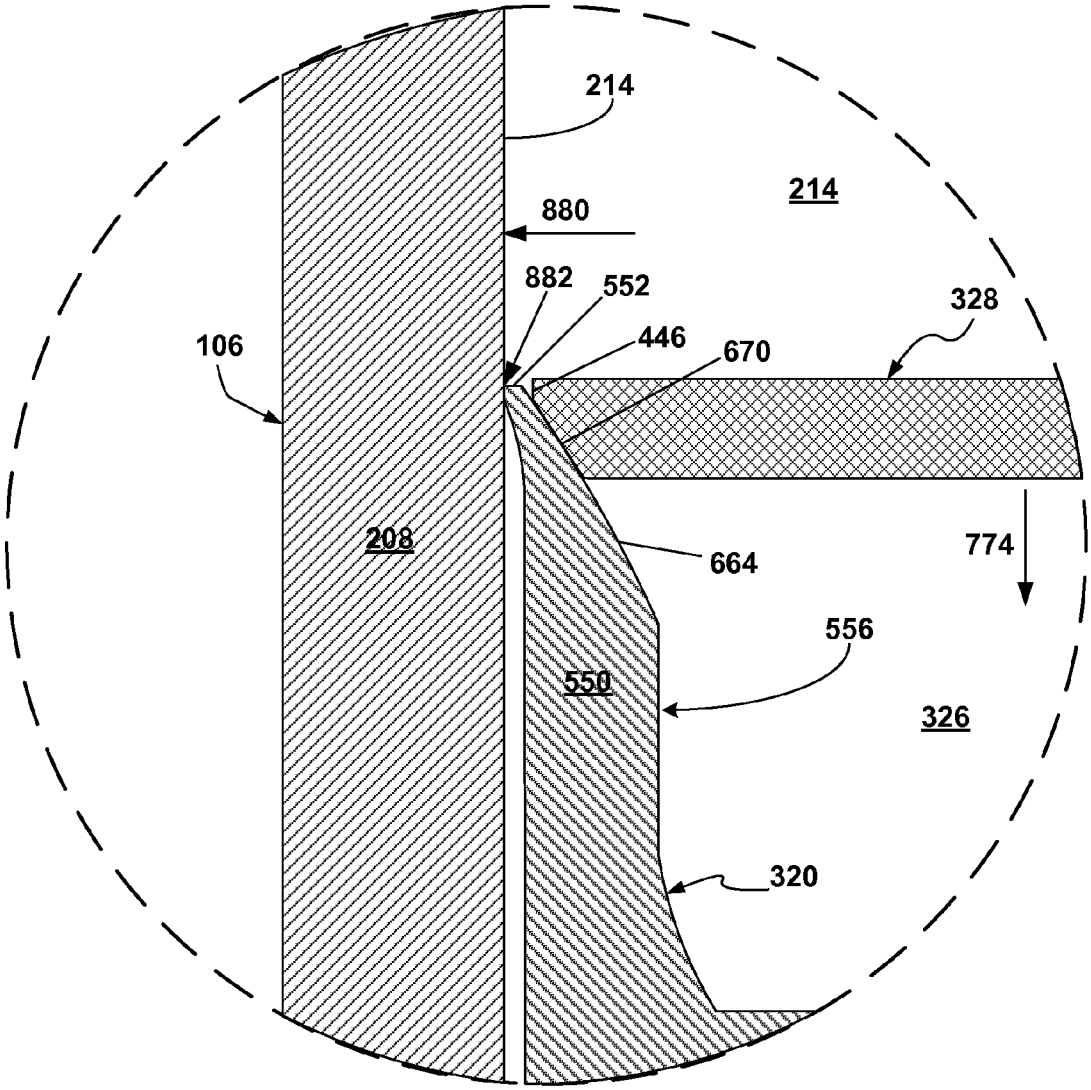
FIG. 8 is an enlarged sectional view of a portion of the adjustable resonator stop of FIG. 2 in an engaged position within a resonator.

As shown in even greater detail in FIG. 8, when the resonator end member 328 is moved to the engaged position as the tightening member 332 draws the resonator end member 328 in a direction towards the resonator engaging body 320, as indicated by arrow 774, the peripheral edge 446 of the resonator end member 328 engages a portion of the interior surface 556 of the resonator engaging body 320. In particular, the tapered surface 670 extending along a periphery of the resonator end member 328 directly engages at least the interior tapered surface 664 of the side wall 550 of the resonator engaging body 320. As the resonator end member 328 is drawn further into the cavity 326 of the resonator engaging body 320, the peripheral edge 446 of the resonator end member applies a force against at least the lip 552 of the resonator engaging body 320, such that at least a portion of the lip 552 is elastically expanded radially in a direction towards the interior surface 214 of the resonator 106, as indicated by arrow 880. At least a portion of the lip 552 is configured to directly engage and sealably conform to an interior dimension of the resonator 106, indicated by arrow 882.

The lip 552 may provide a generally air-tight seal with the interior surface 214 of the resonator 106 such that the interior volume 216, i.e. air column, of the resonator 106 is mostly exposed to the resonator end member 328. The original size and/or shape of the resonator engaging body 320 (i.e. outer diameter $D_2$ of the resonator engaging body 320 when resonator end member 328 is in the engaged position) is configured to provide an adequate slip fit within the resonator 106 such that, in order to securely fix the resonator engaging body 320 to the interior dimension of the resonator 106, the lip 552 need only radially expand a few thousandths of an inch. Thus, the seal may be air-tight and rigid, while minimizing the amount of resonator engaging body 320 exposed to the vibrating air column. In one embodiment, for example, the amount of resonator engaging body 320 exposed to the interior volume 216, i.e. air column of the resonator 106 is less than 5% when the resonator end member 328 is in the engaged position and the resonator stop 218 is securely fixed within the resonator 106. Thus, the resonator end member 328 covers at least about 95% of the air column in the resonator 106. In other embodiments, the amount of the resonator engaging body 320 exposed to the interior volume 216 of the resonator 106 may be as low as 2% or 1% or less when the resonator end member 328 is in the engaged position.

To tune the resonator, therefore, the user loosens the tightening member 332 such that the resonator end member 328 is drawn in a direction away from the resonator engaging body 320, as indicated by arrow 776 (FIG. 7A). The resonator engaging body 320 and particularly the lip 552 includes material capable of elastic recovery such that the lip 552 recovers to its original size and/or shape (i.e., slip fit dimension or outer diameter $D_2$) when the tightening member 332 is loosened. The adjustable resonator stop 218 may then be slid up or down the interior dimension of the resonator 106 as desired, for example, based on weather conditions and/or musician preference. In the desired position, the tightening member 332 may be retightened to move the resonator end member 328 to the engaged position, thereby radially expanding the lip 552 and fixing the adjustable resonator stop 218 in the resonator 106.

Figure 9:
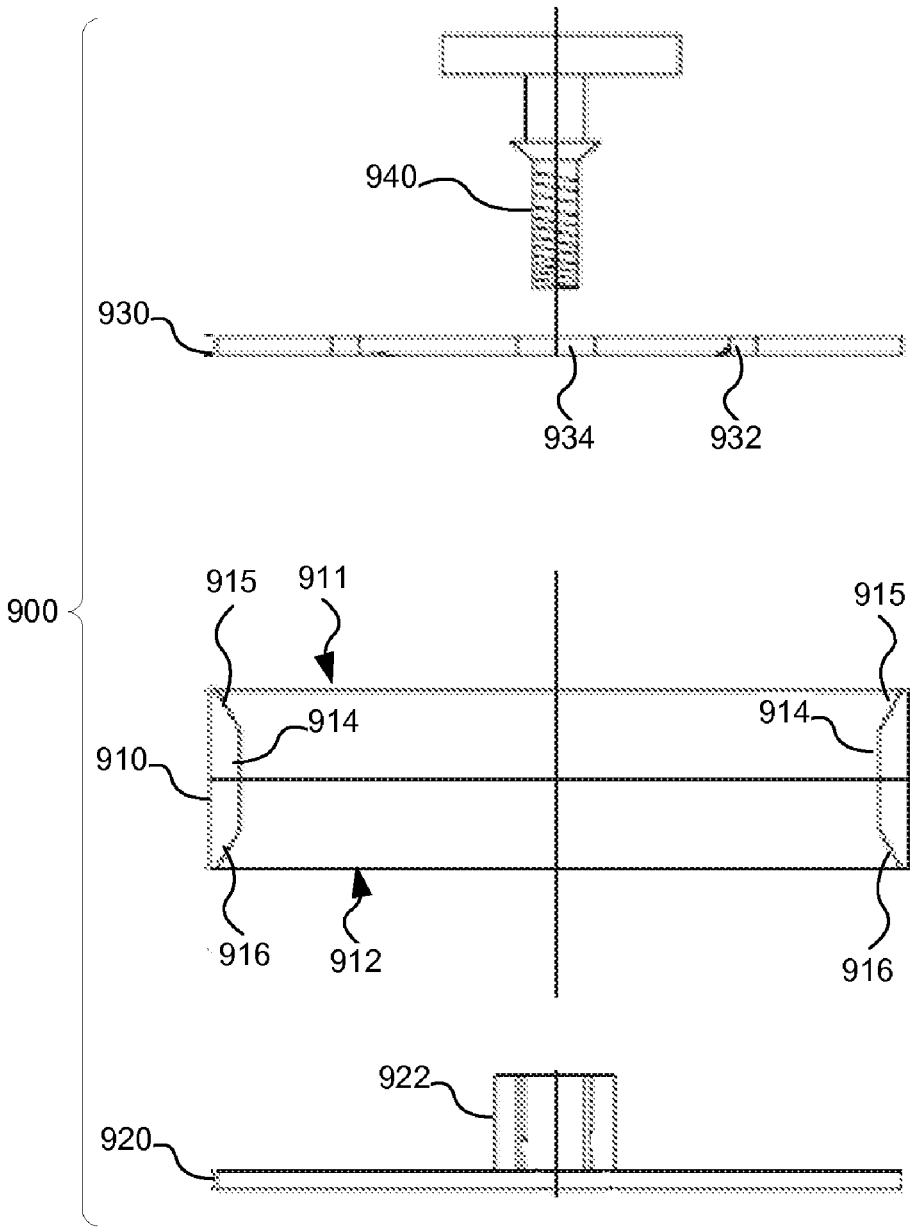
FIG. 9 is an exploded, partially-sectional view of another embodiment of an adjustable resonator stop for use with a resonator of a keyboard percussion instrument.

Referring to FIG. 9, another embodiment of an adjustable resonator stop 900 is shown and described in greater detail. This embodiment of the adjustable resonator stop 900 includes a resonator engaging body 910 having open first and second ends 911, 912 and a side wall 914 with tapered ends 915, 916 (e.g., about 30°). In this embodiment, a first plate 920 acts as the resonator end member and covers the open second end 912 and a second plate 930 covers the open first end 911. The resonator engaging body 910 may be made of a low density polyethylene (LDPE) or other suitable material and the plates 920, 930 may be made of aluminum or other suitable material. The second plate 930 may also be vented, for example, with one or more air vent holes 932.

As illustrated, a tightening member (e.g., a threaded bolt 940) passes through an aperture 934 in the second plate 930 and engages the first plate 920 (e.g., an internally threaded member 922 coupled to the first plate 920). The threaded member 922 may be an aluminum nut spot welded to the center of the first plate 920 or may be formed as one-piece with the first plate 922. Other tightening or engaging mechanisms may also be used.

In operation, the tightening member or threaded bolt 940 causes both plates 920, 930 to be pulled together during tightening to expand the tapered ends 915, 916 of the side wall 914 of the resonator engaging body 910 against a resonator tube. Because the resonator engaging body 910 expands at both ends 915, 916, the tolerances for slip fit may be less critical. A 1.75 in. diameter engaging body 910, for example, may expand about 0.040 in. This embodiment may also produce an even more secure seal against the inside of a resonator tube because it seals at both ends 915, 916 (e.g., top and bottom) of the resonator engaging body 910 and with the same acoustic performance.

An adjustable resonator stop consistent with the present disclosure may be configured to provide substantially the same or better performance characteristics as a permanently installed metal stop including a smooth, metallic, bi-polar vibrating surface with exposure to air on either side, while also providing quick adjustability at little or no cost when compared to other adjustable stops in the industry.

Consistent with one embodiment, an adjustable resonator stop includes a resonator end member configured to be disposed within an interior dimension of a resonator of a keyboard percussion instrument to form a closed end of an air column defined by the resonator and a resonator engaging body configured to be disposed within the interior dimension of the resonator and to engage inner walls of the resonator. The resonator engaging body has a first end and an open second end defining a cavity configured to receive the resonator end member. The adjustable resonator stop also includes a tightening member configured to be coupled to at least a portion of the resonator end member. The tightening member is configured to move the resonator end member relative to the resonator engaging body from a disengaged position to an engaged position with the resonator end member engaging the resonator engaging body and being disposed at least partially within the cavity of the resonator engaging body. The resonator engaging body is disengaged from the resonator in the disengaged position such that the resonator stop is able to traverse within the resonator. The resonator engaging body engages the resonator in the engaged position such that the resonator stop is fixed within the interior dimension of the resonator.

Consistent with another embodiment, a keyboard percussion instrument includes a plurality of tone bars, a plurality of resonators associated with the tone bars, respectively, and acoustically coupled to the tone bars, and at least one adjustable resonator stop configured to be adjustably positioned in at least one of the resonators.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. An adjustable resonator stop comprising:

a resonator end member configured to be disposed within an interior dimension of a resonator of a keyboard percussion instrument to form a closed end of an air column defined by the resonator;

a resonator engaging body configured to be disposed within the interior dimension of the resonator and to engage inner walls of the resonator, the resonator engaging body having a first end and an open second end defining a cavity configured to receive the resonator end member; and a tightening member configured to be coupled to at least a portion of the resonator end member, the tightening member configured to move the resonator end member relative to the resonator engaging body from a disengaged position to an engaged position with the resonator end member engaging the resonator engaging body and being disposed at least partially within the cavity of the resonator engaging body, wherein the resonator engaging body is disengaged from the resonator in the disengaged position such that the resonator stop is able to traverse within the resonator, and wherein the resonator engaging body engages the resonator in the engaged position such that the resonator stop is fixed within the interior dimension of the resonator.

2. The adjustable resonator stop of claim 1 wherein the resonator engaging body further comprises an end wall at the first end and a continuous side wall extending substantially longitudinally from a periphery of the end wall, the side wall terminating at a radially expandable lip of the open second end of the resonator engaging body, the side wall having an exterior surface configured to form a slip fit with the interior dimension of the resonator and having an interior surface defining the cavity of the resonator engaging body.

3. The adjustable resonator stop of claim 2 wherein the end wall defines at least one aperture therein, the at least one aperture configured to receive at least a portion of the tightening member.

4. The adjustable resonator stop of claim 3 wherein the tightening member comprises a first end passing through the at least one aperture defined in the end wall and into the cavity of the resonator engaging body, the first end being coupled to an attachment member on a bottom surface of the resonator end member.

5. The adjustable resonator stop of claim 4 wherein the resonator end member comprises a peripheral edge configured fit within the cavity of the resonator engaging body at least when the resonator end member is in the engaged position.

6. The adjustable resonator stop of claim 5 wherein the tightening member is configured to move the resonator end member to the engaged position, thereby drawing the resonator end member in a direction towards the resonator engaging body and allowing the peripheral edge of the resonator end member to engage at least a portion of the radially expandable lip of the open second end of the resonator engaging body.

7. The adjustable resonator stop of claim 6 wherein the peripheral edge is configured to apply a force to the radially expandable lip, wherein at least a portion of the lip is elastically expanded radially to sealably conform to the interior dimension of the resonator, thereby fixing the resonator engaging body to the interior dimension of the resonator.

8. The adjustable resonator stop of claim 1 wherein the resonator engaging body defines at least one venting aperture at the first end such that air is vented through the resonator engaging body to the resonator end member.

9. The adjustable resonator stop of claim 1 wherein the resonator end member covers at least 95% of the air column in the resonator.

10. The adjustable resonator stop of claim 1 wherein the resonator engaging body is configured to provide an air tight seal against the resonator when the resonator end member is moved to the engaged position by the tightening member.

11. The adjustable resonator stop of claim 1 wherein the resonator end member includes a first plate configured to cover the second open end of the resonator engaging body.

12. The adjustable resonator stop of claim 11 wherein the first end of the resonator engaging body is open, and further including a second plate configured to cover the first end of the resonator engaging body, and wherein the tightening member is configured to pass through the second plate to engage the first plate such that both the first and second plates expand ends of the resonator engaging body when tightened.

13. The adjustable resonator stop of claim 12 wherein the second plate is vented.

14. A keyboard percussion instrument comprising:

a plurality of tone bars;

a plurality of resonators associated with the tone bars, respectively, and acoustically coupled to the tone bars;

at least one adjustable resonator stop configured to be adjustably positioned in at least one of the resonators, the adjustable resonator stop comprising:

a resonator end member configured to be disposed within an interior dimension of a resonator of a keyboard percussion instrument to form a closed end of an air column defined by the resonator;

a resonator engaging body configured to be disposed within the interior dimension of the resonator and to engage inner walls of the resonator, the resonator engaging body having a first end and an open second end defining a cavity configured to receive the resonator end member; and a tightening member configured to be coupled to at least a portion of the resonator end member, the tightening member configured to move the resonator end member relative to the resonator engaging body from a disengaged position to an engaged position with the resonator end member engaging the resonator engaging body and being disposed at least partially within the cavity of the resonator engaging body, wherein the resonator engaging body is disengaged from the resonator in the disengaged position such that the resonator stop is able to traverse within the resonator, and wherein the resonator engaging body engages the resonator in the engaged position such that the resonator stop is fixed within the interior dimension of the resonator.

15. The keyboard percussion instrument of claim 14 wherein the resonator engaging body defines at least one venting aperture at the first end such that air is vented through the resonator engaging body to the resonator end member.

16. The keyboard percussion instrument of claim 14 wherein the resonator end member covers at least 95% of the air column in the resonator.

17. The keyboard percussion instrument of claim 14 wherein the resonator engaging body is configured to provide an air tight seal against the resonator when the resonator end member is moved to the engaged position by the tightening member.

18. The keyboard percussion instrument of claim 14 further comprising a plurality of adjustable resonator stops located in a plurality of the resonators, respectively.

19. The adjustable resonator stop of claim 14 wherein the resonator end member includes a first plate configured to cover the second open end of the resonator engaging body.

20. The adjustable resonator stop of claim 18 wherein the first end of the resonator engaging body is open, and further including a second plate configured to cover the first end of the resonator engaging body, and wherein the tightening member is configured to pass through the second plate to engage the first plate such that both the first and second plates expand ends of the resonator engaging body when tightened.

* * * * *